United States Patent [19]

Nocerino

[11] Patent Number: 4,559,988

[45] Date of Patent: Dec. 24, 1985

[54] DRAPERY TIEBACK ASSEMBLY

[76] Inventor: Grace L. Nocerino, 3470 S. Nucla Way, Aurora, Colo. 80013

[21] Appl. No.: 483,681

[22] Filed: Apr. 11, 1983

[51] Int. Cl.[4] ..... A47H 19/00; A47H 13/14

[52] U.S. Cl. ..... 160/349 D

[58] Field of Search ..... 160/349 D; 248/201

[56] References Cited

U.S. PATENT DOCUMENTS

| | | | |
|---|---|---|---|
| 237,821 | 2/1881 | Claussen | 248/201 |
| 409,760 | 8/1889 | Shinn | 160/349 D |
| 577,449 | 2/1897 | Preuss et al. | 160/349 D |
| 1,487,372 | 3/1924 | Cobel | 248/201 X |
| 1,817,962 | 8/1931 | Breuer | 160/349 D |
| 1,882,527 | 10/1932 | Stanley . | |
| 2,180,219 | 11/1939 | Wormley | 156/33 |
| 2,251,512 | 8/1941 | Bush et al. | 156/33 |
| 2,365,664 | 12/1944 | Troensegaard et al. | 160/349 |
| 2,584,224 | 2/1952 | Pfaffko | 160/349 |
| 2,773,546 | 12/1956 | Doty | 160/349 |
| 3,420,289 | 1/1969 | Bejarano | 160/349 |
| 3,866,659 | 2/1975 | Kaminski | 160/349 D |
| 4,022,415 | 5/1977 | Roderick et al. | 248/298 |
| 4,343,344 | 8/1982 | Shelton | 160/349 D |

*Primary Examiner*—J. Franklin Foss
*Assistant Examiner*—Cherney S. Lieberman
*Attorney, Agent, or Firm*—John E. Reilly

[57] ABSTRACT

A drapery tieback assembly includes a tieback member in combination with a support bracket for gathering a drapery to one side and securing it in spaced relation to a wall. The tieback member has a wall support portion and a stem projecting normal thereto with a knob at the distal end thereof. The support bracket includes a mounting base having on one side edge an elongated arm member projecting forwardly at right angles therefrom.

7 Claims, 5 Drawing Figures

DRAPERY TIEBACK ASSEMBLY

This invention generally relates to a tieback assembly for curtains and drapes, and more particularly relates to a novel and improved bracket used in combination with a conventional tieback knob in order to support the drapery a preselected distance away from the wall from which it is hung.

BACKGROUND AND FIELD OF THE INVENTION

In the field of interior decorating, it is common practice to utilize a window treatment wherein a vertically pleated drapery is gathered to one side and held at its midportion by a flexible sash or tieback to create a decorative swag effect. Frequently the arrangement includes an underlying sheer curtain which is allowed to hang straight downwardly from the curtain rod to cover the window, thereby affording both privacy and a pleasing area. In effecting this treatment, however, the decorator may encounter certain aesthetic and practical difficulties. In a typical tieback arrangement, one end of the sash is fastened to a tieback knob or bracket by a hook or other means, then the sash is drawn around the drapery and similarly fastened at its opposite end to the knob. Frequently, the return folds or pleats are crushed by the sash, and the drapery is flattened against the wall, thus detracting from the appearance of the arrangement and often causing excessive and uneven wear on the underside or lining of the curtain. Moreover, the resulting distortion of the outer drapery interferes with the uniform vertical hang and operation of the inner sheer as well.

Improvements in tieback brackets and fastening devices have been proposed in the past to eliminate the aforesaid problems. Representative of these are U.S. Pat. Nos. 3,420,289 to A. V. Bejarano; 3,866,659 to F. Kaminski; and 4,022,415 to Z. A. Roderick et al. All of these patents are directed to sash-retaining brackets and holders which project outwardly from the wall and are concealed within a pleat of the drapery so that both drapery and sash are supported in spaced relation to the wall and the proper shape of the return folds is maintained. Although devices of this type are effective for certain arrangements, their applications are somewhat limited in that they require special mounting directly to the wall and do not permit much latitude in aesthetic expression, such as, in the ability to use different types of tieback knobs to achieve special decorative effects, or the ability to easily adjust the distance the curtain is held from the wall to allow for different fabric weights and pleat or return depth.

SUMMARY OF THE INVENTION

It is therefore an object of the present invention to provide for a novel and improved drapery bracket which is adaptable for use with virtually any conventional tieback knob or fastener, and includes means for supporting a drapery a selected adjustable distance from the wall or window so that an attractive, uniform swag-type effect is presented.

It is another object of the present invention to provide for a novel and improved drapery bracket including means for fastening a tieback sash around a drapery in a manner which avoids distortion of the pleats or gathers and maintains the shape of the return.

A further object of the present invention is to provide for a novel and improved drapery bracket for use in window treatments combining an outer drapery with a sheer or lightweight inner curtain, the bracket including means for retaining the tieback sash and for supporting the outer curtain at a preselected distance from the wall so as to prevent crushing of the sheer and to preserve the decorative appearance of the drapery arrangement.

A still further object of the present invention is to provide for a novel and improved drapery bracket which can be easily and conveniently attached to a wall together with any conventional tieback knob, without damage to the knob or the use of additional hardware.

It is an additional object of the present invention to provide for a drapery bracket which supports a drapery in adjustable spaced relation to a wall and is completely concealed by the drapery while in use.

Yet another object of the present invention is to provide a drapery bracket which is adapted to be mounted on either the right or left tieback knob without modification.

A further object of the present invention is to provide a drapery bracket having removable and adjustable extension means for spacing the drapery a greater distance from the wall to accommodate unusually heavy or deeply pleated draperies, alone or in combination with sheers.

In accordance with the present invention, a drapery tieback assembly comprises a tieback member in combination with a support bracket for gathering a drapery to one side and securing it in spaced relation to a wall. The tieback member includes a wall support portion and a stem projecting normal to the wall support portion and having a knob or enlarged portion at the distal end thereof. The support bracket includes a wall mounting base interposed between the wall support portion and the wall, an elongated arm member extending away from the base in spaced parallel relation to the stem, and means for fastening opposite ends of a tieback to the arm member and the tieback member in spaced relation to the wall. More particularly, the support bracket comprises a mounting base or flange having on one side edge an elongated arm member projecting forwardly at right angles therefrom. The flange is adapted to be positioned behind the mounting base of a conventional tieback knob and mounted on the wall therewith so that the arm member projects forwardly in perpendicular relation to the wall adjacent to a drapery to be tied back. The arm is provided with a series of spaced apertures along its length which are adapted to retain a drapery hook or similar tieback fastening means. A tieback provided with such means is attached at one end to the tieback knob; the opposite free end is drawn around the drapery to encircle same and is anchored by inserting the hook in a selected one of the spaced apertures in the bracket arm. By virtue of the forward projection of the arm, both the tieback and the drapery are supported away from the wall and the underlying sheer curtain. Moreover, the apertures permit ready adjustment of the distance or clearance between the drapery and the wall or sheer.

The above and other objects, advantages and features of the present invention will become more readily appreciated and understood when taken together with the following detailed description of a preferred embodiment of the present invention in conjunction with the accompanying drawings, in which:

DETAILED DESCRIPTION OF THE PREFERRED EMBODIMENT

Figure 1:
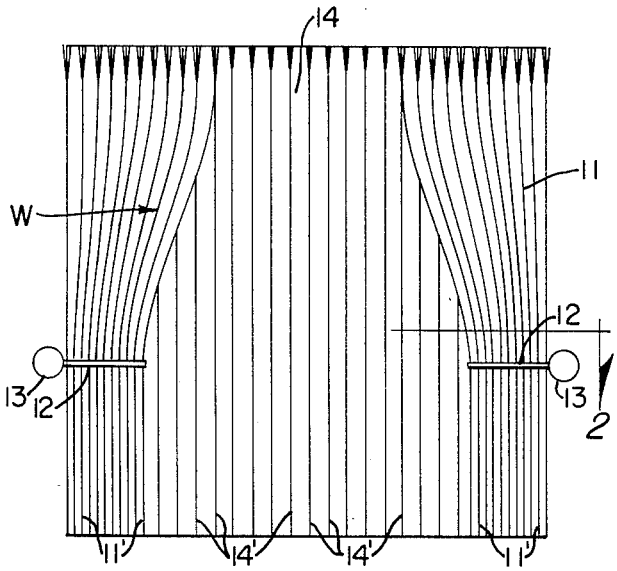
FIG. 1 is a front view in elevation of a window treatment utilizing the drapery bracket of the present invention and illustrating the appearance that is thereby achieved.

FIG. 1 illustrates a decorative window treatment employing the bracket arrangement 10 of the present invention in which outer draperies 11 are drawn to either side of window W by means of tiebacks or sashes 12 fastened to decorative tieback knobs 13. A sheer inner curtain 14 is suspended between outer drapery 11 and window W so that a pleasing swag effect is obtained without sacrificing privacy. Ideally, both inner and outer curtains 14, 11, respectively, should hang evenly as shown with no distortion or flattening of the pleats or gathers 11', 14', respectively.

The desired effect may be achieved by utilizing the bracket arrangement 10 illustrated in FIGS. 2 through 5, which includes a drapery support bracket 15 and tieback knob 13. The knob 13 itself may be of conventional construction and typically comprises a mounting base 20 including upper and lower screw-receiving apertures 23, 24, respectively, a stem portion 21 and decorative knob face 22. It is, however, a feature of the invention that virtually any conventional knob can be employed with the bracket 15 of the present invention, so that the decorator need not be restricted to the limited selection of ornamental effect available in specially designed tieback supports of the prior art.

Figure 5:
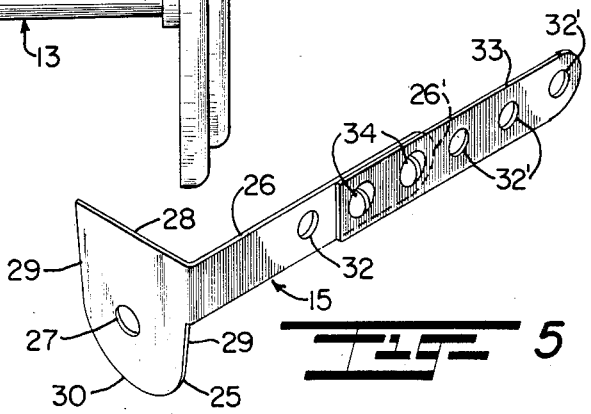
FIG. 5 is a perspective view of the bracket illustrating both the preferred and modified forms thereof.

Drapery support bracket 15 is shown most clearly in FIG. 5 and comprises a flange or flat wall support portion 25 which is preferably in the form of a thin flat plate and integral arm member 26 projecting at right angles therefrom. Flange 25 is provided with an aperture 27, for a purpose to be described hereinbelow, a horizontal upper edge 28, side edges 29, and curved or semi-circular lower edge 30. Side and lower edges 29, 30 are preferably configured to substantially correspond to the lower curved edge 31 of the base 20 of the tieback knob. The perpendicular arm member 26 is preferably defined by a thin, flat elongated bar which projects forwardly from the upper portion of one side edge 29 of the flange 25, and terminates in a rounded or tapered forward end 26'. The arm member 26 is provided along its length with a plurality of longitudinally spaced apertures 32 which are sized to retain a drapery hook inserted therethrough. An optional extension member 33 is substantially similar in structure to arm member 26, and may be connected thereto by one or more pairs of nut and bolt or similar fastening means 34 inserted in adjacent, aligned pairs of apertures 32, 32' so as to establish the desired overall length of the arm.

Figure 3:
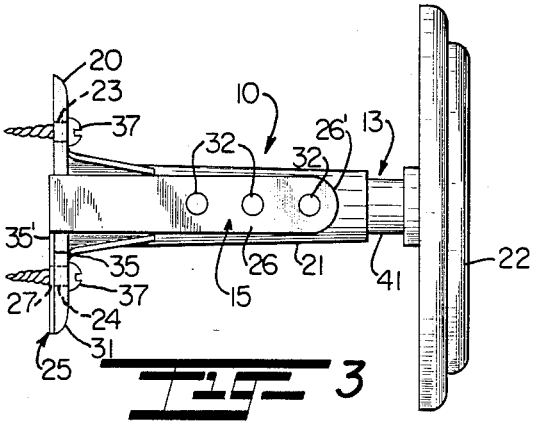
FIG. 3 is a side view in elevation of the drapery bracket and tieback knob.
Figure 2:
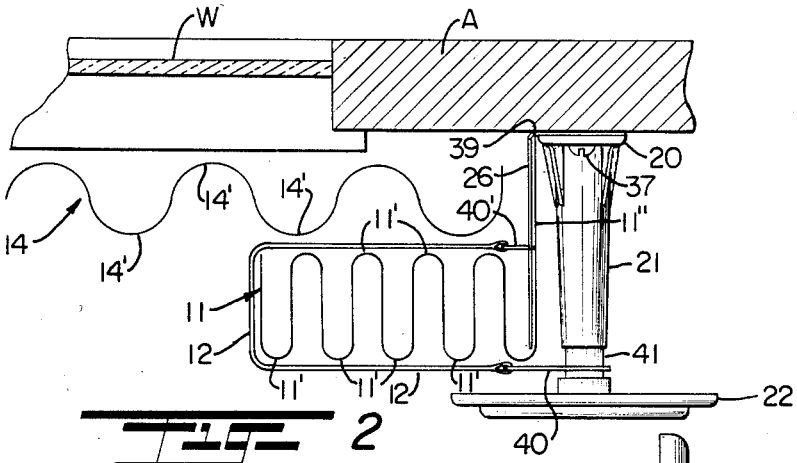
FIG. 2 is a view partially in section taken along lines 2—2 of FIG. 1, illustrating the preferred form of drapery bracket in combination with a conventional tieback knob.
Figure 4:
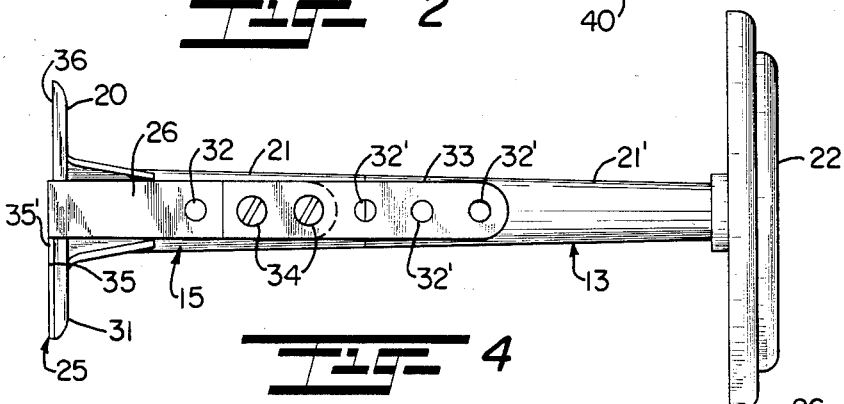
FIG. 4 is a side view in elevation of a modified form of drapery bracket illustrated in combination with an extendable tieback knob.

With particular reference to FIGS. 2 and 3, it is seen that bracket 15 is mounted on a wall A together with tieback knob 13 by placing outwardly facing flange surface 35 against wall-facing surface 36 of knob base 20, then aligning lower screw-receiving aperture 24 on knob 13 with aperture 27 on bracket flange 25. Suitable masonry fasteners or wood screws 37 are inserted through upper aperture 23 and aligned apertures 24, 27 to permit the bracket and knob arrangement 10 to be mounted on the wall in the usual manner. Thus, the opposite surface 35' of flange 25 is caused to bear firmly against the wall A, and the arm 26 projects forwardly from the inner side of tieback base 20 between the window W and tieback knob 13. Further, it will be seen in FIG. 2 that the corner formed by the intersection of flange 25 and arm 26 is preferably spaced a slight distance away from the edge of knob base 20 to form a gap or clearance 39 of about $\frac{1}{8}''$, for a purpose to be made evident hereinafter.

Use of the bracket arrangement 10 in the drapery treatment of FIG. 1 is best illustrated in cross-section in FIG. 2. A tieback 12 is made up of a length of fabric, chain or similar decorative material, and is provided at either end with hooks 40, 40' or other suitable fasteners. Outer hook 40 is attached to a reduced portion 41 of the stem 21 of knob 13, and the outer drapery 11 is gathered to one side by passing tieback 12 horizontally around the drapery 11 and anchoring inner hook 40' at the opposite end of tieback 12 in a selected one of the apertures 32 in the bracket 15.

The choice of aperture will depend upon the depth of pleats 11' of drapery 11 and upon the amount of clearance desired between drapery 11 and wall A or sheer 14. As a result, the drapery 11 is gently supported within the space defined by the encircling tieback 12 rather than being crushed and "tied" to one side. If the pleats 11' are unusually deep, or if the drapery 11 is to be supported a greater distance from the wall, the extension member 33 of FIGS. 4 and 5 may be employed as described above; and a stem extension member 21', such as, those frequently supplied in tieback knob kits, may be used to add the necessary length to the stem portion 21.

It will be appreciated that the use of bracket 15 in combination with the conventional tieback knob 13 permits adjustable positioning of the outer drapery 11 relative to the wall A so that both drapery 11 and sheer 14 hang evenly and freely with no distortion of the pleats 11', 14'. Moreover, the bracket is entirely concealed from sight by the outer drapery 11. The edge of the outermost pleat 11'' returns nearly to the wall and is seated within the aforementioned gap 39 between bracket arm 26 and knob base 20, so that only the decorative knob 13 is exposed.

FIG. 2 illustrates a bracket 15 mounted on the right side of a window W. For convenience in assembly and manufacturing, the brackets 15 may be installed interchangeably on either side of the window. An identical bracket is mounted on the left side of the window merely by inverting the bracket 15 so that the curved lower edge 30 of the flange 25 is directed upwardly and the arm member 26 projects from what is now the lower portion of the flange 25. Flange 25 is then positioned behind the mounting base 20 of knob 13 in the above-disclosed manner, but is placed so that aperture 27 is aligned with upper screw-receiving aperture 23 in base 20 and the curved flange edge 30 substantially corresponds to the upper curved edge of base 20. Accordingly, the arm 26 of the inverted bracket 15 will extend outwardly from the right, inner side of knob 13, so that a tieback 12 may be attached as described above.

It is therefore to be understood that while the present invention has been described with particularity relative to the foregoing description of preferred and alternate embodiments, other modifications, changes and additions may be made and will be readily apparent to those of ordinary skill in the art without departing from the spirit and scope of the present invention.

I claim:

1. In a drapery tieback assembly adapted for gathering each of a pair of drapes to one side and securing same with a tieback in spaced relation to a wall and to opposite sides of a sheer curtain extending parallel to the wall, said assembly having a pair of tieback holder members with one said holder member disposed outwardly of each side of said curtain, each said holder member including a wall support portion, a stem projecting normal to said wall support portion, and an enlarged distal end spaced from the wall, the improvement comprising: a support bracket for each said holder member including a wall mounting base interposed between said wall support portion and the wall, said wall-mounting base being a relatively thin, flat base plate underlying said wall portion, mounting means interposing said wall mounting base between said wall support portion and said wall, an elongated arm member extending away from said base in closely spaced, parallel relation to said stem and between said stem and said curtain, said arm member being offset from said common mounting means; and first fastener means for securing one end of said tieback to said stem and second fastener means for securing an opposite end of said tieback to said elongated arm spaced between said first fastener means and said wall whereby to retain said drape in spaced parallel relation to the wall and to said sheer curtain.

2. In a drapery tieback assembly according to claim 1, said first fastener means comprising a first hook member securing one end of said tieback to said stem, and said second fastener means comprising a second hook member on the opposite end of said tieback insertable into a selected one of a plurality of spaced apertures formed along the length of said elongated arm member in progressive spaced relation to said wall to space said tieback and said drape a predetermined distance from said wall.

3. In a drapery tieback assembly according to claim 2, said tieback assembly including a support bracket extension member having means for detachable connection to the distal end of said elongated arm member and provided with a plurality of spaced apertures adapted to retain said second hook member, a stem extension member removably attached between said stem and said distal end.

4. In a drapery tieback assembly according to claim 3, said detachable connection means on said support bracket extension member having at least one pair of pin members inserted for transverse extension through adjacent pairs of aligned apertures in said arm member and said support bracket extension member.

5. In a drapery tieback assembly according to claim 1, wherein said wall support portion is provided with an upper and a lower aperture, each receiving a wall-engaging member inserted therethrough, and said wall mounting base is provided with an aperture alignable with one of said upper and lower apertures for interchangeable mounting on either side of a window.

6. In a drapery tieback assembly wherein a drapery is gathered on opposite sides of a window and secured on each side with a tieback in spaced parallel relation to a sheer curtain extending between the drape and the window opening with a first tieback holder member on each side including a wall support portion, a stem projecting from said wall support portion normal to the wall and terminating in an enlarged decorative knob disposed in front of said drape, the improvement comprising:

a support bracket on each side of said window opening including a wall mounting base plate interposed between said wall support portion and the wall, common wall-mounting means comprising a first aperture formed in said wall-mounting base plate aligned with a second aperture formed in said wall support portion, and a wall-engaging member inserted through said aperture to secure said tieback assembly to said wall, an elongated flat arm member extending away from a side edge of said wall mounting base plate normal to said wall and in inwardly spaced, parallel relation to each said tieback holder member, and means for adjustably connecting opposite ends of each said tieback to said stem and said elongated arm member, respectively, comprising first fastener means securing one end of said tieback to said stem, and second fastener means on the opposite end of said tieback inserted into a selected one of a plurality of spaced apertures provided along the length of said elongated arm member and being spaced between said first fastener means and said sheer curtain whereby to position said drapery between said decorative knob and said sheer curtain a predetermined distance in front of and parallel to said sheer curtain; and a support bracket extension member detachably connected to the distal end of each said elongated arm and provided with a plurality of spaced apertures to retain said second fastener means therein and means adjustably spacing said enlarged distal end a predetermined distance from said wall.

7. In a drapery tieback assembly according to claim 6, said support bracket extension member being detachably connected to said elongated arm by means of pin members inserted transversely through adjacent pairs of aligned apertures in said elongated arm and said support bracket extension member.

* * * * *